US007047692B2

(12) United States Patent
Benoit et al.

(10) Patent No.: US 7,047,692 B2
(45) Date of Patent: May 23, 2006

(54) WINDOW LIFTER FOR A VEHICLE DOOR

(75) Inventors: Dominique Benoit, St. Jean le Blanc (FR); Sylvain Chonavel, Thury Harcourt (FR)

(73) Assignee: ArvinMeritor Light Vehicle Systems - France, Sully-sur-Loire (FR)

( * ) Notice: Subject to any disclaimer, the term of this patent is extended or adjusted under 35 U.S.C. 154(b) by 0 days.

(21) Appl. No.: 10/462,383

(22) Filed: Jun. 16, 2003

(65) Prior Publication Data

US 2003/0233791 A1 Dec. 25, 2003

(30) Foreign Application Priority Data

Jun. 19, 2002 (FR) ..... 02 07566

(51) Int. Cl.
*E05F 11/48* (2006.01)

(52) U.S. Cl. ..... 49/352

(58) Field of Classification Search ..... 49/348, 49/349, 352, 502; 295/146.5, 146.7
See application file for complete search history.

(56) References Cited

U.S. PATENT DOCUMENTS

| | | | | |
|---|---|---|---|---|
| 5,617,675 | A * | 4/1997 | Kobrehel | 49/352 |
| 5,685,111 | A * | 11/1997 | Zimmerer et al. | 49/352 |
| 6,115,966 | A * | 9/2000 | Shibata | 49/352 |
| 6,354,652 | B1 * | 3/2002 | Arquevaux et al. | 296/146.5 |
| 6,397,524 | B1 * | 6/2002 | Sakaguchi et al. | 49/375 |
| 6,510,657 | B1 * | 1/2003 | Bertolini et al. | 49/502 |
| 2002/0050099 | A1 * | 5/2002 | Marscholl | 49/352 |
| 2003/0009948 | A1 * | 1/2003 | Nishikawa et al. | 49/502 |

FOREIGN PATENT DOCUMENTS

| | | | |
|---|---|---|---|
| DE | 37 18 840 | 6/1988 | |
| FR | 2 802 238 | 6/2001 | |
| JP | 3-279574 | * 12/1991 | 49/352 |
| JP | 6-42256 | * 2/1994 | 49/352 |
| JP | 6-167166 | * 6/1994 | 49/352 |

OTHER PUBLICATIONS

French Search Report dated Feb. 20, 2003.

* cited by examiner

*Primary Examiner*—Jerry Redman
(74) *Attorney, Agent, or Firm*—Carlson, Gaskey & Olds

(57) ABSTRACT

A vehicle window lifter includes first and second parallel guide rails, a connecting arm rigidly connecting the guide rails at a point along the rails between their ends, and cable returns defining a cable path along the rails and connecting arm. The connecting arm and guide rails form a cable path for a cable, protecting the cable while providing high rigidity and simple mounting on a vehicle door.

20 Claims, 2 Drawing Sheets

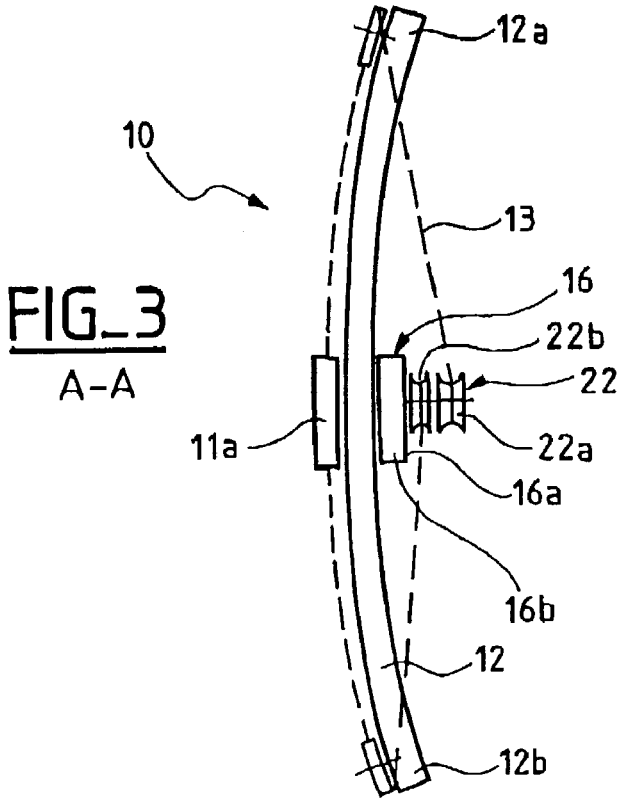
FIG_3
A-A
FIG_4
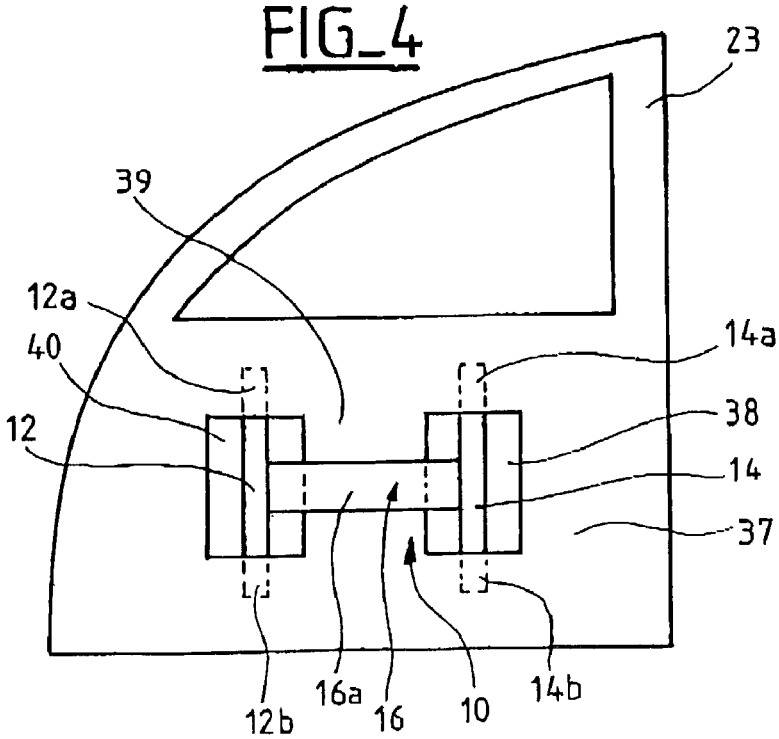

WINDOW LIFTER FOR A VEHICLE DOOR

REFERENCE TO RELATED APPLICATIONS

The present invention claims priority to French Patent Application No. 02 07 566, filed Jun. 19, 2002.

1. Technical Field

The present invention relates to a window lifter, and more particularly to a vehicle door having such a window lifter.

2. Background of the Invention

Window lifters in vehicle doors are often difficult to mount. Several solutions have been proposed for mounting the window lifter in the door.

French patent 2,761,104 discloses a window lifter having two substantially parallel rails with cables in an X-configuration between the rails and sliding thereon. The window lifter also includes an X-shaped support joining the upper ends and enveloping the cables. The support provides rigidity for the window lifter, which can be mounted in a modular fashion in a large opening in the door. This window lifter suffers from the disadvantage of requiring large amounts of material for enveloping the cable over the whole length thereof between the rails, making the window lifter expensive to manufacture. Additionally, this type of window lifter cannot be installed into every type of vehicle door. Indeed, this type of window lifter must be installed via a large opening in the door, but certain doors may have small openings that limit access to the inside of the door. Additionally, the X-shaped crossing arrangement occupies a lot space inside the door, preventing other items of equipment being incorporated into the door.

U.S. Pat. No. 5,617,675 discloses a collapsible window lifter that is installed through openings that limit access to the inside of the door. This is achieved by incorporating a U-shape in the window lifter. The vertical arms of the slider-guiding U pivot at one of their ends on the base of the U. To introduce the window lifter through the opening, the vertical arms are folded down against the base of the U. Once the window lifter is in place, the vertical arms are unfolded inside the door and then secured thereto.

This window lifter nevertheless has the disadvantage of being highly complex and expensive to produce because of the pivoting arrangements. Unfolding the arms becomes increasingly complex as the opening in the door becomes narrower. Additionally, folding and unfolding the arms may degrade cable tension in the window lifter. Further, rigidity at the free end of the vertical arms is decreased, leading to the arms bending which is prejudicial to the securing of the window lifter. Also, when the door has a concave shape, the radius of curvature applied to the window lifter for matching the shape of the door prevents a complete folding of the window lifter; thus, introducing a window lifter into the door opening becomes more complex.

There is consequently a need for a window lifter that is less expensive to manufacture and that is flexible enough to be readily mounted on a vehicle door while still providing adequate protection for the cable.

SUMMARY OF THE INVENTION

The invention according to one embodiment is a window lifter comprising a first and a second parallel guide rail, a connecting arm rigidly connecting the said rails, the connecting arm being connected to the guide rails at a point along the rails between their ends, with cable returns defining a cable path along the said rails and said connecting arm.

According to one embodiment, the connecting arm extends at least in part outside a surface defined by the guide rails. Other embodiments incorporate details such as forming an angle of between 45° and 135° with respect to the connecting arm and one of the rails, and/or locating the connecting arm substantially at a half-way point along said rails.

According to one embodiment, the first and second guide rails carry a cable return at each of their ends and the connecting arm has a cable return at each one of its ends. One of the cable returns of the connecting arm may carry a motor and speed reduction gear.

According to one embodiment, the guide rails are of metal and the connecting arm is of plastic material. According to a further embodiment the guide rails each carry a projecting part extending towards the other rail, each of said projecting parts carrying a cable return directing the cable path along the connecting arm. The guide rails and the connecting arm may have supports for automobile fixtures.

The invention is also directed to a vehicle door having an inventive window lifter is also provided. According to one embodiment, the door includes a hollow section and openings for introducing the window lifter into the hollow section, the first and second rails extending inside the hollow section and the connecting arm being outside the hollow section.

In other embodiments of the vehicle door, the connecting arm supports a window lifter motor and speed reduction gear and/or the vehicle door includes automobile fixtures secured on the connecting arm Further characteristics and advantages of the invention will become clearer from the following description of some embodiments of the invention provided by way of non- and limiting example, and with reference to the attached drawings.

BRIEF DESCRIPTION OF THE DRAWINGS

FIG. 3 is a section through the window lifter of FIG. 1 along line A—A.

FIG. 4 shows a vehicle door incorporating the window lifter of FIG. 2.

DETAILED DESCRIPTION OF PREFERRED EMBODIMENTS

A window lifter according to one embodiment of the invention comprises two parallel guide rails which are rigidly connected by a connecting arm. Generally, the connecting arm is connected to the guide rails between their ends, along the rails. Cable returns define a cable path along the rails and arm. This window lifter is more rigid at the free ends of the guide rails since the connecting arm is connected remotely from the ends of the rails. Moreover, because the rigidity of the window lifter is simply provided by one single connecting arm extending from one guide rail to the other, the window lifter saves on material while simultaneously ensuring the cable is protected as it runs along the rails.

Figure 1:
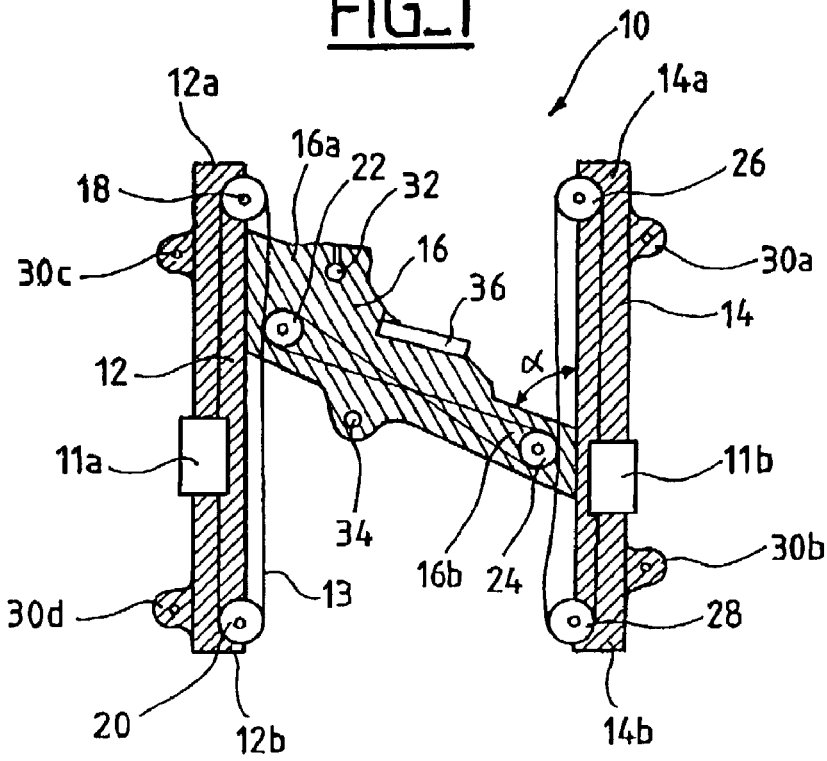
FIG. 1 shows a window lifter according to one embodiment of the invention.

FIG. 1 shows one embodiment of the window lifter of the invention. The window lifter 10 comprises a first guide rail 12 and a second guide rail 14. The rails 12, 14 respectively guide linear movement of sliders 11*a* and 11*b*. The sliders 11*a* and 11*b* are secured to a window glass (not shown) of the vehicle. Incorporating two guide rails allows movement of the window glass at two points, ensuring that the glass will not swing while it is moving. The guide rails are rigidly connected together by a connecting arm 16.

The connecting arm 16 has two ends 16*a* and 16*b* through which the connecting arm 16 is joined to the guide rails 12, 14 at a point between the ends of the rails 12, 14. Cable returns 18, 20, 22, 24, 26, 28 define a cable path along the rails 12, 14 and the arm 16. A cable 13 drives the sliders 11*a* and 11*b* while being protected from deterioration as the cable 13 runs close to the rigid rails 12, 14 and connecting arm 16.

The guide rails 12, 14 may be made of, for example, metal or plastic material. The guide rails 12, 14 can be manufactured by pressing or by molding. The guide rails 12, 14 are preferably mutually parallel so that the sliders 11*a*, 11*b* are driven in parallel directions to allow the window glass to move without encumbrance. The guide rails 12, 14 include fixing lugs 30*a*, 30*b*, 30*c*, 30*d* for securing the window lifter 10 onto the vehicle door. For driving sliders 11*a*, 11*b* via the cable, the guide rails 12 and 14 have respective cable returns 18, 20 and 26, 28 at each end. The cable returns can be, for example, pulleys. Cable tensioners can be provided on the pulleys, spreading the pulleys apart to lengthen the cable path.

In one embodiment, the connecting arm 16 is made of a metal or plastic material formed by pressing or molding. It can either be a member that is secured onto the guide rails or be integrally constructed with the guide rails. In the latter case, the connecting arm 16 can be obtained by cutting a metal plate which is then pressed, or it can be obtained by molding a complete rail and arm assembly.

In one embodiment, the guide rails 12, 14 are made of metal and connecting arm 16 is made of plastic material. This allows cost and weight savings in the assembly. In one embodiment, the guide rails 12, 14 each have a projecting part extending towards the other rail, and each projecting part carries a cable return 22, 24 directing the cable path along the connecting arm 16. The advantage is that the stresses set tip by operation of the cable returns 22, 24 are taken up by the guide rails 12, 14, The connecting arm 16 is then preferably secured between these two projecting parts and their associated cable returns 22,24.

The connecting arm 16 rigidly connects the guide rails 12, 14, allowing the cable to be tensioned while the window lifter is being assembled. Cable tension is thus preserved during handling and transport of the window lifter. Additionally, the rigidity of the window lifter allows more ready assembly on the vehicle door. Indeed, the upper ends of the guide rails 12, 14 are firstly secured to the door. The rigidity of the window lifter then allows the lower ends of the rails 12,14 to come in blind fashion to the designed securing position on the door.

The connecting arm 16 is connected to the guide rails 12, 14 between their ends, along the rails. For example, for a rail which is 450 cm long, the connecting arm 16 can be connected to the guide rails 12, 14 at a point at least 30 cm from the end of a guide rail 12, 14. Compared to a U-shaped window lifter, the advantage of the connecting arm according to the invention is that the rails 12, 14 are kept rigid, particularly at the free ends of the rails. The guide rails 12, 14 of the invention are therefore connected together at regions that are closer to the center of the rails rather than at the ends of the rails, as is the case in a U-shaped window lifter. By connecting the middle portions, and not the ends, of the guide rails 12, 14, the invention limits deflection at each of the free ends of guide rails 12, 14.

Figure 2:
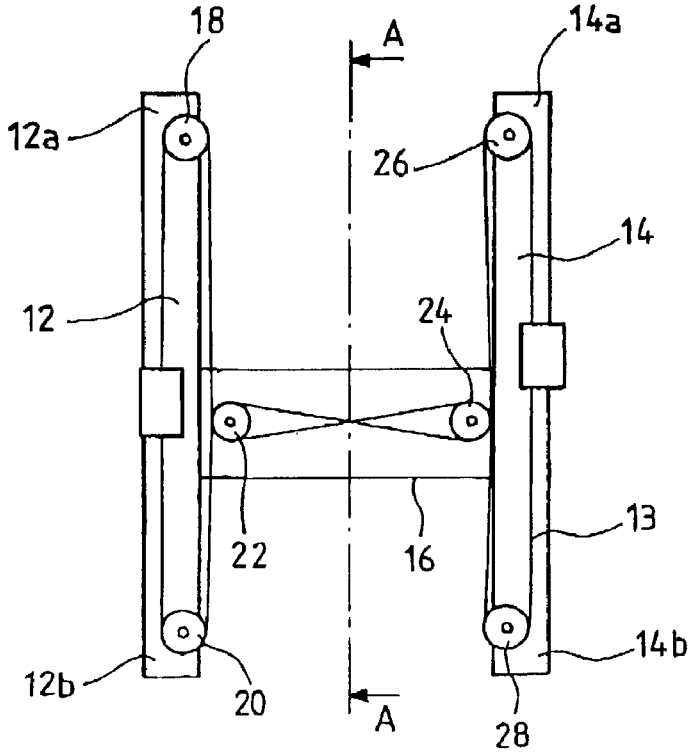
FIG. 2 shows a window lifter of FIG. 1 according to another embodiment.

FIG. 2 shows a window lifter according to another embodiment of the invention. This embodiment maximizes the rigidity in the window lifter. The amount of deflection at a point on the guide rail is proportional to the distance between this point and another point at which the guide rail and the connecting arm join. Thus, the smallest simultaneous deflection at the free ends 12*a*, 12*b*, 14*a*, 14*b* of the rails 12, 14 is obtained when the connecting arm is substantially at half the length of the guide rails and substantially perpendicular to the guide rails 12, 14. In this embodiment, the window lifter generally has an H-shape.

In one embodiment, the connecting arm 16 and guide rails 12, 14 can include supports for automobile fixtures. For example, the supports may be designed to carry a loudspeaker, door lock, armrest, or other fixtures. The rigidity of the window lifter provides support for the fixtures as well as forces occurring during use of the door. For example, when a passenger closes the door using the armrest, the window lifter can take up the forces resulting from the door closing. The window lifter can therefore help limit sagging of the door.

The inclination and position of fixing the connecting arm along the guide rails allows the window lifter to be adapted to securing automobile fixtures. The connecting arm offers numerous possible positions for fastening the fixtures, depending on the height and length of the door. Thus, the connecting arm can form an angle $\alpha$ between 45° and 135° with respect to one of the guide rails 12, 14. In FIG. 1, the connecting arm 16 makes an angle $\alpha$ of about 45° with respect to guide rail 14. Thus, the connecting arm 16 passes through a central region of the door allowing, for example, the handle for closing the door to be secured to points 32 and 34 on the connecting arm 16, along with the armrest in the region identified by reference numeral 36 (FIG. 1).

Another advantage of the connecting arm 16 is that it can be adapted as a function of door geometry to allow components of the door to be fitted. Currently known X-shaped window lifters cannot be adapted to door geometry.

The cable 13 returns 18, 20, 22, 24, 26, 28 define a cable path along the rails 12, 14 and the connecting arm 16. The cable 13 follows the rigid rails 12, 14, and the connecting arm 16, allowing it to be protected from deterioration. Further, the connecting arm 16 reduces the amount of material needed to protect the cable 13, particularly when compared to an X-shaped window lifter.

In the embodiment shown in FIG. 1, the first rail 12 and the second rail 14 have a cable return 18, 20, 26, 28 at each of their free ends allowing the cable to extend along the rails for driving the sliders 11*a* and 11*b*. The cable returns can be, for example, pulleys. The connecting arm 16 also has cable returns 22, 24, which allow the cable to be guided and protected along arm 16.

FIG. 3 is a section view of the window lifter of FIG. 2 taken along line A—A. The cable return 22 can be seen more clearly in FIG. 2. In FIG. 3, it can be seen that cable return 22 has two parts 22*a* and 22*b* to drive cable 13 twice, as can be seen in FIG. 2. In FIG. 3, the two parts 22*a* and 22*b* of the cable return 22 are rotatably mounted independently of each other so that the cable 13 is rotatably driven in two different directions. The cable return 22 is, for example, composed of two pulleys 22*a* and 22*b* sharing a common axis of rotation. The pulleys may also be arranged side by side with non-common axes of rotation. The cable return 24 has the same structure as cable return 22.

FIG. 3 shows a guide rail 12 having a curved shape to allow it to be adapted to a vehicle door having a curved profile. Of course, the other guide rail 14 (not shown in FIG. 3) will also have a curved shape to accommodate the profile of the door.

The cable 13 is driven by a motor having a speed reduction gear (not shown), which can be secured at any point along the cable path except on the path of the sliders. In one alternative embodiment, one of the cable returns 22, 24 guiding the cable 13 along the connecting arm 16 carries the motor and speed reduction gear. As shown in FIG. 3, one of the cable returns 22, 24 of the connecting arm 16 carries a motor and speed reduction gear. The speed reduction gear can take the place of the cable return part 22*b* and have a part 22*a* fixed thereon, using a common axis with the speed reduction gear. This reduces the number of cable returns in the system and allows the stresses on the motor and speed reduction gear and cable return part 22*a* to be taken up on a common axis.

The window lifter can be secured inside a door having openings that limit access to the inside of the door. For this purpose, the connecting arm 16 is offset with respect to the guide rails 12, 14. In FIG. 3, the connecting arm 16 extends at least partially outside the surface defined by the guide rails 12, 14. The central portion 16*a* of the connecting arm 16 (visible in FIG. 2) lies in a surface that is offset with respect to the surface defined by the guide rails. The central portion 16*a* supports the cable returns 22 and 24. The offset is, for example, provided by giving connecting arm 16 a U-shape, the central portion of the U being the portion 16*a* of the connecting arm 16. The connecting arm is for example obtained by pressing or molding. The connecting arm 16 then carries lugs 16*d*, shown in FIG. 3, at both sides of the central portion 16*a*, allowing the central portion 16*a* to be joined to the guide rails 12, 14. In another embodiment, the central portion 16*a* is joined to the cable rails 12, 14 by bracing members 16*b* to which, for example, central portion 16*a* is welded.

FIG. 4 shows a door 23 of the vehicle carrying the window lifter of FIG. 2 and exhibiting offset of the connecting arm 16. The door shown in FIG. 4 can incorporate a window lifter either with or without cable returns. To reinforce vehicle door rigidity, automobile manufacturers limit access to the inside of the door. The openings provided in the door allow equipment and fixtures to be introduced inside the door. In FIG. 4, the door 23 has a hollow section 37 and openings 38, 40 that allow equipment and fixtures to be introduced into the door 23. The openings 38, 40 allow the window lifter 10 to be placed into the hollow section 37. The openings 38, 40 are separated by a support portion 39 ensuring rigidity of the door 23. The hollow section 37 delimits a damp and dry region, one inside the hollow section and the other outside, towards the inside of the vehicle.

As shown in FIG. 4, the first guide rail 12 and second guide rail 14 are inside the hollow section 37 and the connecting arm 16 is the outside hollow section 37. The window lifter 10 can be arranged in the door by, for example, first introducing the upper ends 12*a* and 14*a* of the guide rails 12, 14 into the openings 38, 40. The ends 12*a* and 14*a* are then inserted more deeply into hollow section 37 toward the top of the door until the lower ends 12*b*, 14*b* of the guide rails 12, 14 can be introduced via openings 38, 40 into hollow section 37. The connection between the connecting arm 16 and the guide rails 12, 14 at a point between their ends allows such a maneuver.

The window lifter 10 is then lowered towards the bottom of the door and then secured in position by, for example, using the fixing lugs 30*a* and 30*d* (FIG. 1). Securing the window lifter may be conducted by, for example, first fixing the upper ends 12*a*, 14*a* to the door 23. The rigidity of the window lifter 10 will allow the lower ends 12*b*, 14*b*, to move into position. Note that the order in which the ends of the window lifter 10 are introduced into the door 23 is not limited to the discussion above.

The shape of the connecting arm 16 outside the surface defined by the guide rails 12, 14 allows the connecting arm to rest on the support portion 39, outside the hollow section 37, while the guide rails 12, 14 remain inside the hollow section. Having the connecting arm 16 outside the hollow section 37 allows the motor and speed reduction gear to be arranged on the arm 16 and kept in the dry region of the door.

According to another embodiment, the support portion 39 of the door 23 has a concave shape, which is pushed in toward the inside of hollow section 37. This allows the window lifter 10 to be arranged inside the hollow section 37 without any portion of the connecting arm 16 being disposed outside the surface defined by the guide rails. This facilitates manufacture of window lifter 10. The invention also concerns the door 23 of the vehicle carrying the window lifter described.

Obviously, the present invention is not limited to the embodiments described above by way of example. For example, the embodiment where at least one part of the connecting arm 16 is disposed outside the surface defined by guide rails 12 and 14 is not limited to a window lifter 10 with an H-shape and the connecting arm inclined with respect to the guide rails; the offset can also be obtained with a window lifter 10 having generally a U-shape. Further, the invention is not limited to a door having two openings 38, 40 as shown in FIG. 4; the door can, for example, have a longitudinal opening running in the direction of movement of the vehicle, or with a length slightly greater than the width of the window lifter. It can also be arranged to provide the window lifter described in the bodywork of a hatchback vehicle, at the height of the rear seat passengers.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A window lifter comprising:

a first guide rail and a second guide rail disposed parallel to each other, the first guide rail and the second guide rail each having a first end and a second end;

a connecting arm rigidly connecting the first guide rail and the second guide rail, the connecting arm being connected to the first guide rail and the second guide rail between the first end and the second end of each of the first guide rail and the second guide rail; and a plurality of cable returns defining a cable path along the first guide rail and the second guide rail and along the connecting arm, wherein the first end and the second end of the first guide rail, the first end and the second end of the second guide rail and a first end and a second end of the connecting arm each carry one of the plurality of cable returns, wherein the cable path defines a closed loop, and the cable path includes a first portion that extends along each of the first guide rail and second guide rail and a second portion that extends from the first end of the first guide rail to the second end of the second guide rail and from the second end of the first guide rail to the first end of the second guide rail, wherein a substantial portion of the second portion extends along the first guide rail and the second guide rail and a remaining portion of the second portion extends along the connecting arm, and wherein the cable path includes a first side and an opposing second side, and the first side of the remaining portion of the second portion is covered and protected by the connecting arm and the opposing second side of the remaining portion of the second portion is exposed.

2. The window lifter according to claim 1, wherein the connecting arm extends at least in part outside a plane defined by the first guide rail and the second guide rail.

3. The window lifter according to claim 1, wherein the connecting arm and one of the first guide rail and the second guide rail form an angle ($\alpha$) of between 45° and 135°.

4. The window lifter according to claim 1, wherein the connecting arm is disposed at substantially a half-way point between the first end and the second end of at least one of the first guide rail and the second guide rail.

5. The window lifter according to claim 1, further comprising a motor and a speed reduction gear carried on the one of the plurality of cable returns on the connecting arm.

6. The window lifter according to claim 1, wherein the first guide rail and the second guide rail are made of metal and the connecting arm is made of plastic material.

7. The window lifter according to claim 6, wherein the first guide rail and the second guide rail each comprise a projecting part extending toward the other of the first guide rail and the second guide rail, wherein each of the projecting parts carry one of the plurality of cable returns to direct the cable path along the connecting arm.

8. The window lifter according to claim 1, further comprising at least one support disposed on at least one of the first guide rail and the second guide rail and the connecting arm to support an automobile fixture.

9. The window lifter according to claim 1, further comprising at least one cable tensioner disposed on at least one of the plurality of cable returns.

10. The window lifter as recited in claim 1, wherein the first portion extends from the first end of the first guide rail to the second end of the first guide rail and from the first end of the second guide rail to the second end of the second guide rail.

11. The window lifter as recited in claim 1, wherein the plurality of cable returns comprise a first cable return, a second cable return, a third cable return, a fourth cable return, a fifth cable return and a sixth cable return, and the first end of the first guide rail carries the first cable return, the second end of the first guide rail carries the second cable return, the first end of the second guide rail carries the third cable return, the second end of the second guide rail carries the fourth cable return, a first end of the connecting arm carries the fifth cable return, and a second end of the connecting arm carries the sixth cable return, wherein the first portion extends from the first cable return to the second cable return and extends from the third cable return to the fourth cable return, wherein the substantial portion of the second portion extends from the first cable return to the fifth cable return and extends from the fourth cable return to the sixth cable return, and wherein the remainder portion of the second portion extends from the fifth cable return to the sixth cable return and extends from the sixth cable return to the fifth cable return.

12. The window lifter as recited in claim 1, wherein the entire remaining portion of the second portion extends along the connecting arm.

13. The window lifter as recited in claim 1, wherein the plurality of cable returns comprise two cable returns located on the connecting arm, wherein the remaining portion of the second portion extends between the two cable returns.

14. The window lifter as recited in claim 1, wherein the remaining portion of the second portion is substantially parallel to the connecting arm.

15. The window lifter as recited in claim 1, wherein the cable path defines a plane, and the first side of the cable path in on one side of the plane and the opposing second side of the cable path is on an opposing side of the plane.

16. A vehicle door, comprising:

a window lifter having:

a first guide rail and a second guide rail disposed parallel to each other, the first guide rail and the second guide rails each having a first end and a second end, a connecting arm rigidly connecting the first guide rail and the second guide rail, the connecting arm being connected to the first guide rail and the second guide rail between the first end and the second end of each of the first guide rail and the second guide rail, and a plurality of cable returns defining a cable path along the first guide rail and the second guide rail and along the connecting arm, wherein the first end and the second end of the first guide rail, the first end and the second end of the second guide rail and a first end and a second end of the connecting arm each carry one of the plurality of cable returns, wherein the cable path defines a closed loop, and the cable loop includes a first portion that extends along each of the first guide rail and the second guide rail and a second portion that extends from the first end of the first guide rail to the second end of the second guide rail and from the second end of the first guide rail to the first end of the second guide rail, wherein a substantial portion of the second portion extends along the first guide rail and the second guide rail and a remaining portion of the second portion extends along the connecting arm, wherein the cable path includes a first side and an opposing second side, and the first side of the remaining portion of the second portion is covered and protected by the connecting arm and the opposing second side of the remaining portion of the second portion is exposed; and a support structure for supporting the window lifter in the vehicle door.

17. The vehicle door according to claim 16, wherein the support structure comprises at least a first opening and a second opening for introducing the first guide rail and the second guide rail of the window lifter, respectively, into a hollow section of the vehicle door, wherein the connecting arm extends at least in part outside a plane defined by the first guide rail and the second guide rail such that the first guide rail and the second guide rail extend inside the hollow section and the connecting arm is disposed outside the hollow section.

18. The vehicle door according to claim 17, further comprising a motor and a speed reduction gear supported by the connecting arm.

19. The vehicle door according to claim 16, further comprising at least one automobile fixture secured on the connecting arm.

20. The vehicle door according to claim 16, further comprising at least one cable tensioner disposed on at least one of the plurality of cable returns.

* * * * *